US009624071B2

(12) United States Patent
Hanvey et al.

(10) Patent No.: US 9,624,071 B2
(45) Date of Patent: Apr. 18, 2017

(54) ELEVATOR PASSENGER INTERFACE INCLUDING SPECIAL ASSISTANCE FEATURES

(75) Inventors: Dennis Hanvey, Leonardo, NJ (US); John Eschenbrenner, Canton, CT (US); Michael P. Flynn, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 433 days.

(21) Appl. No.: 14/351,969

(22) PCT Filed: Oct. 18, 2011

(86) PCT No.: PCT/US2011/056669

§ 371 (c)(1),
(2), (4) Date: Apr. 15, 2014

(87) PCT Pub. No.: WO2013/058734

PCT Pub. Date: Apr. 25, 2013

(65) Prior Publication Data

US 2014/0299421 A1 Oct. 9, 2014

(51) Int. Cl.
*B66B 1/34* (2006.01)
*B66B 1/46* (2006.01)

(52) U.S. Cl.
CPC ..... *B66B 1/46* (2013.01); *B66B 1/34* (2013.01); *B66B 1/463* (2013.01); *B66B 2201/401* (2013.01); *B66B 2201/402* (2013.01)

(58) Field of Classification Search
CPC .. B66B 1/46; B66B 1/34; B66B 1/463; B66B 2201/401; B66B 2201/402
USPC ..... 187/247, 380–388, 391, 395, 396, 901
See application file for complete search history.

(56) References Cited

U.S. PATENT DOCUMENTS 6,382,363 B1 5/2002 Friedli
6,696,926 B2 * 2/2004 Tsukamoto ..... B66B 1/462 187/391
6,828,918 B2 12/2004 Bowman et al.
6,902,041 B2 6/2005 Eccleston
(Continued)

FOREIGN PATENT DOCUMENTS

JP 2000034066 2/2000
JP 2001002332 1/2001
(Continued)

OTHER PUBLICATIONS

State Intellectual Property Office of People's Republic China, First Search, Application No. 201180074301.3, dated Dec. 11, 2014.
(Continued)

*Primary Examiner* — Anthony Salata
(74) *Attorney, Agent, or Firm* — Carlson, Gaskey & Olds

(57) ABSTRACT

An exemplary elevator passenger interface device includes a touch screen configured to allow a passenger to indicate a request for elevator service by touching the screen. An assistance button is positioned near the touch screen. A controller is configured to determine a destination requested by a passenger touching the screen. The controller is also configured to determine whether the assistance button has been manipulated and then to determine a destination requested by a passenger from a subsequent manipulation of the assistance button.

22 Claims, 4 Drawing Sheets

(56) References Cited

U.S. PATENT DOCUMENTS

| | | | | |
|---|---|---|---|---|
| 7,207,422 | B2 * | 4/2007 | Takeuchi | B66B 1/463 187/391 |
| 7,377,364 | B2 | 5/2008 | Tyni et al. | |
| 7,559,408 | B2 | 7/2009 | Flynn et al. | |
| 7,562,748 | B2 | 7/2009 | Stranieri et al. | |
| 8,757,329 | B2 * | 6/2014 | Taiana | B66B 1/468 187/391 |
| 8,763,762 | B2 * | 7/2014 | Finschi | B66B 1/468 187/391 |
| 8,820,486 | B2 * | 9/2014 | Gerstenkorn | B66B 1/468 187/247 |
| 9,045,314 | B2 * | 6/2015 | Finschi | B66B 1/467 |
| 2004/0000453 | A1 | 1/2004 | Eccleston | |
| 2007/0181379 | A1 | 8/2007 | Flynn et al. | |
| 2007/0272495 | A1 | 11/2007 | Makela et al. | |
| 2008/0264731 | A1 | 10/2008 | Mangini et al. | |

FOREIGN PATENT DOCUMENTS

| | | | |
|---|---|---|---|
| JP | 2002037552 | A | 2/2002 |
| JP | 2005162465 | | 6/2005 |
| JP | 20060088503 | | 4/2006 |
| JP | 2006188343 | | 7/2006 |
| WO | 2004089800 | | 10/2004 |
| WO | 2007046807 | A1 | 4/2007 |
| WO | 2011121907 | | 10/2011 |

OTHER PUBLICATIONS

International Preliminary Report on Patentability for International application No. PCT/US2011/056669 dated May 1, 2014.

International Search Report and Written Opinion of the International Searching Authority for International application No. PCT/US2011/056669 dated May 18, 2012.

Extended European Search Report for European Application No. 11874355.8, mailed May 15, 2015.

* cited by examiner

ELEVATOR PASSENGER INTERFACE INCLUDING SPECIAL ASSISTANCE FEATURES

BACKGROUND

Elevator systems are in widespread use for carrying passengers between different levels in a building. Over the years, there have been a variety of advances and changes in elevator system components. One such advance has been in the area of passenger interfaces. Traditionally, hall call buttons allowed a passenger to request an elevator car to carry them up or down from their current location. More sophisticated devices have been introduced that allow a passenger to specify their intended destination before they board an elevator car. Such destination-entry systems present a variety of possibilities for configuring the passenger interface.

A contemporary device that is well-suited for destination-entry passenger interfaces is a touch screen that displays information to a passenger and allows a passenger to make selections to communicate their intended destination to the elevator system. One advantage to touch screen displays is that they provide an ability to customize the display to meet passenger or building owner needs, for example. One drawback to touch screen displays, however, is that they typically do not allow visually impaired or blind passengers to communicate their intended destinations to the elevator system. The nature of a touch screen display does not allow for tactical indicators that would assist a visually impaired or blind person to make an appropriate selection or to otherwise interact with the passenger interface device.

SUMMARY

An exemplary elevator passenger interface device includes a touch screen configured to allow a passenger to indicate a request for elevator service by touching the screen. An assistance button is positioned near the touch screen. A controller is configured to determine a destination requested by a passenger touching the screen. The controller is also configured to determine whether the assistance button has been manipulated and then to determine a destination requested by a passenger from a subsequent manipulation of the assistance button.

An exemplary method of facilitating an elevator service request from at least one passenger includes providing a passenger interface device having a touch screen configured to allow a passenger to indicate a request for elevator service by touching the screen and an assistance button near the touch screen. The method includes determining a destination requested by a passenger responsive to a passenger touching an appropriate portion of the touch screen. The method also includes determining a destination requested by a passenger responsive to a passenger manipulating the assistance button and then subsequently manipulating the assistance button.

The various features and advantages of disclosed examples will become apparent to those skilled in the art from the following detailed description. The drawings that accompany the detailed description can be briefly described as follows.

DETAILED DESCRIPTION

Figure 1:
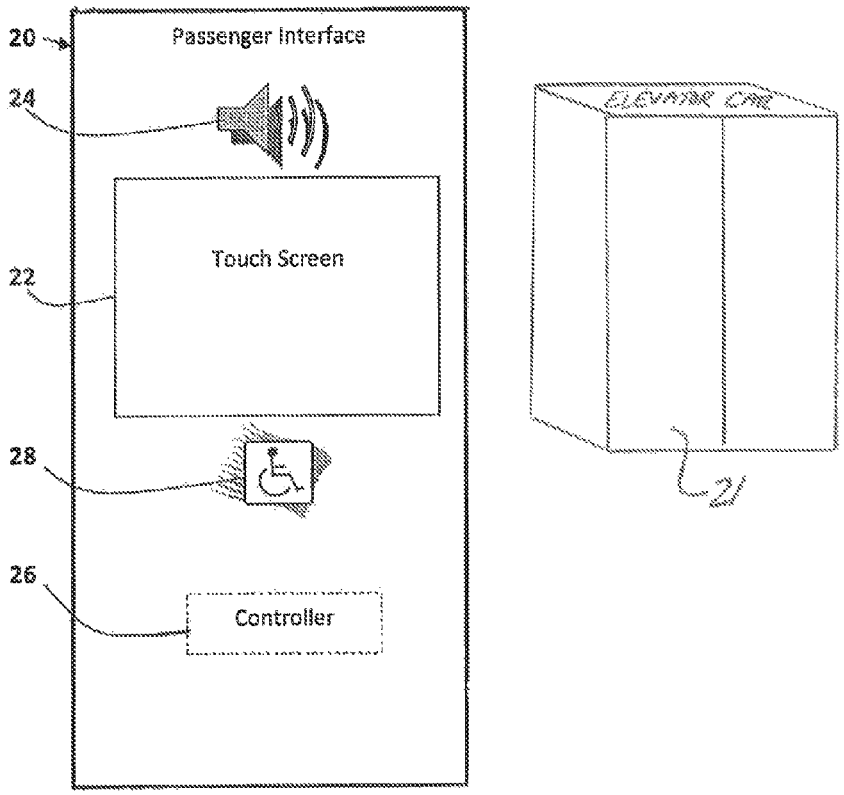
FIG. 1 schematically illustrates an example passenger interface device designed according to an embodiment of this invention.

FIG. 1 schematically shows a passenger interface device 20. The example device 20 is useful for allowing a passenger to indicate a desired destination before the passenger boards an elevator car 21. The illustrated example is also useful within an elevator car to allow a passenger to make a selection regarding an intended destination after the passenger has boarded the elevator car.

The passenger interface 20 includes a touch screen 22 that is configured to allow a passenger to make a selection or otherwise provide an indication of an intended destination. The passenger may obtain information by viewing the touch screen 22, by hearing audible announcements through a speaker 24, or both. A controller 26 is configured to determine the intended destination of a passenger who utilizes the touch screen 22 in an appropriate manner.

The example of FIG. 1 includes an assistance button 28 that is useful for allowing visually impaired or blind passengers to provide an indication of an intended destination. The assistance button 28 is also useful to assist passengers who may not be able to utilize the touch screen 22 for other reasons. The controller 26 determines when the assistance button 28 has been manipulated by a passenger and then subsequently manipulated by a passenger for purposes of determining the intended destination of that passenger. For purposes of discussion, manipulating the assistance button 28 includes pressing the button, holding the button and releasing the button, for example. The controller 26 is configured or programmed to recognize different kinds of manipulations of the assistance button 28, depending on the particular embodiment, several of which are described below. The assistance button 28 allows a passenger who cannot interact through the touch screen 22 to provide an indication of an intended destination to the elevator system and to obtain information from the system through the speaker 24, for example.

Figure 2:
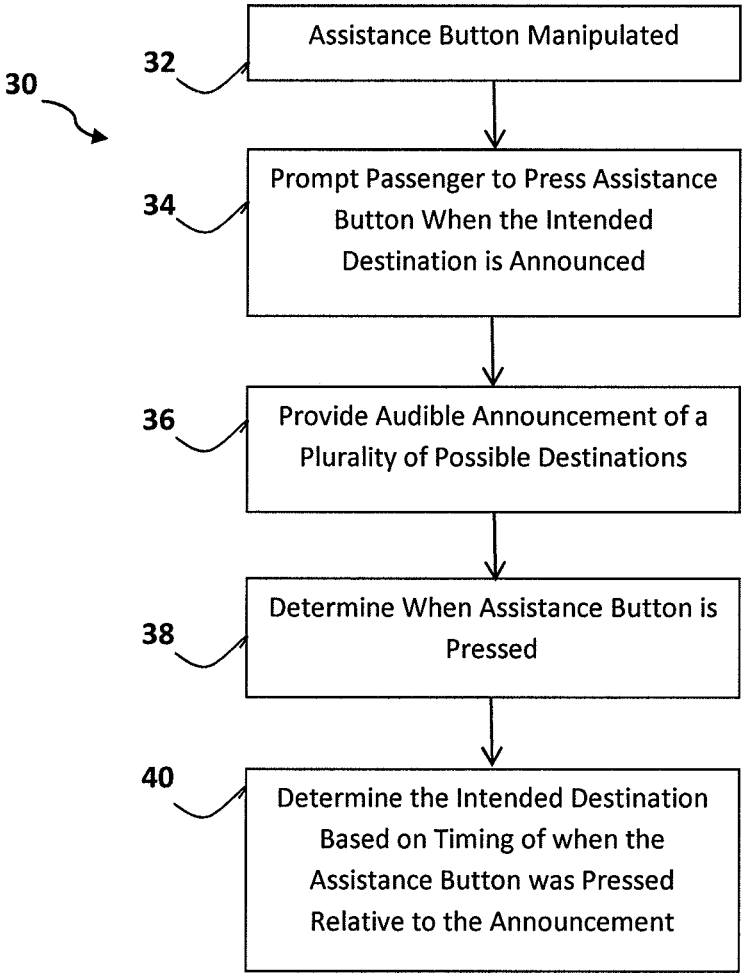
FIG. 2 is a flowchart diagram summarizing one example operation of a passenger interface device designed according to an embodiment of this invention.

FIG. 2 includes a flowchart diagram 30 that summarizes one example technique for utilizing the assistance button 28. A determination is made at 32 that the assistance button 28 has been manipulated. In this example, the initial manipulation comprises a passenger pressing the assistance button 28. Such manipulation is interpreted by the controller 26 based upon switch operation, for example. At 34, the passenger is prompted to press the assistance button when the intended destination is announced. In one example, the controller 26 causes an audible announcement to be provided over the speaker 24 such as, "Please press the accessibility button when your desired floor is announced."

As shown at 36, an audible announcement of a plurality of possible destinations is provided over the speaker 24, for example. In one example, there is a several second delay between the end of one destination announcement and a beginning of the next destination announcement. The delay allows the passenger to press the assistance button after hearing the intended destination before the next announcement. At 38 the controller 26 determines when the assistance button is pressed during the sequence of destination announcements. At 40 the controller 26 determines the intended destination based on the timing of when the assistance button was pressed relative to the announcement. In this example, the most recently announced destination prior to the assistance button 28 being pressed is determined to be the passenger's intended destination.

In one example, once the controller 26 determines the intended destination, an audible confirmation and instructions are provided through the speaker 24 to the passenger to direct them to an appropriate elevator car. One example includes scheduling the assigned elevator car to remain at the landing where the passenger should board the car for an appropriate time that accommodates any extended walking time for the individual to arrive at the car and to board the car, for example.

In one example, while the controller 26 is sequentially providing an audible announcement of the possible destinations, the controller determines whether the touch screen 22 has been touched. The controller in such an example accepts contact with the touch screen 22 as a selection of the most recently announced destination. This accommodates the possibility that a passenger begins the assistance operation by manipulating the assistance button 28 and then subsequently utilizing the touch screen, perhaps inadvertently, for making the selection regarding the intended destination.

In one example, if the controller 26 begins the audible announcements and provides an indication of each possible destination without detecting any selection made by a passenger, the assistance operation times out and the controller returns to normal operation.

Figure 3:
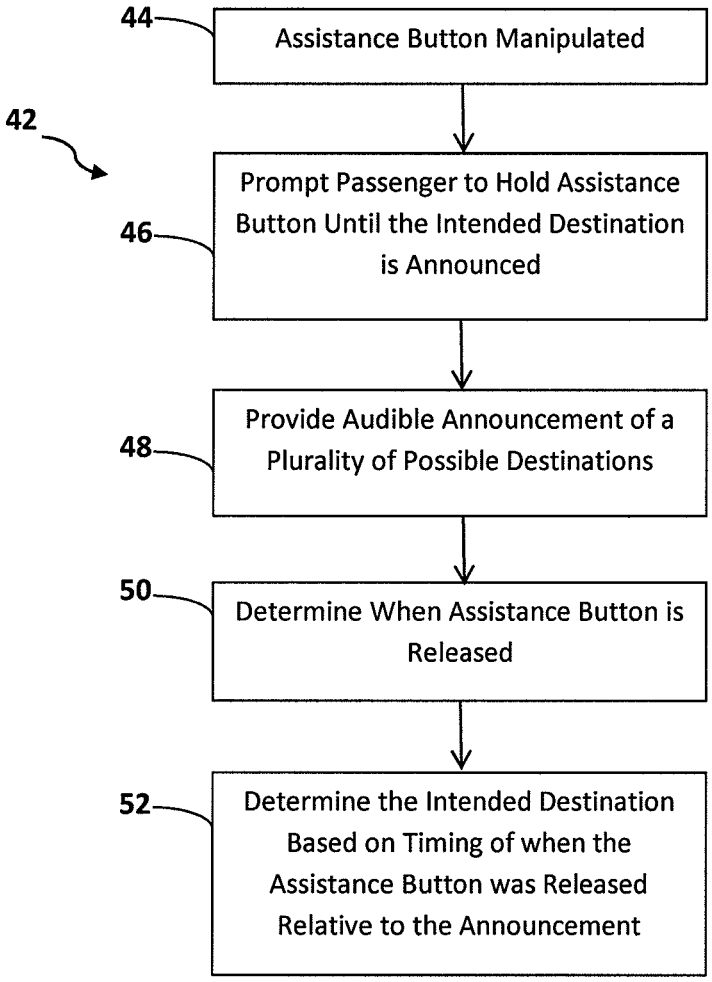
FIG. 3 is a flowchart diagram summarizing another example operation.

FIG. 3 includes a flowchart diagram 40 that summarizes another example technique. At 44 a determination is made that the assistance button 28 has been manipulated. In this case, the manipulation comprises the button being either pressed and held or pressed and released. At 46 the passenger is prompted to hold the assistance button 28 in a pressed position until the intended destination of that passenger is announced. In the case of the passenger still holding the button, the passenger will be prompted to continue to do so until the intended destination is announced. In a situation where the passenger has pressed and released the button 28, the passenger will be prompted to once again press the button and hold it until the intended destination is announced.

At 48, the controller 26 causes audible announcements of a plurality of possible destinations to be provided over the speaker 24. One example includes a several second delay between the end of one destination announcement and the beginning of the next destination announcement. If the passenger releases the assistance button 28 after one of the destination announcements that is determined to be the intended destination as shown at 52.

In one example, the passenger interface device 20 provides an audible and visual confirmation of the determined intended destination and provides information to the passenger to allow them to reach the appropriate elevator car in situations in which the passenger interface device 20 is located outside of an elevator car. For situations in which the interface device 20 is inside of an elevator car, the confirmation may simply provide an indication of the determined destination, or it may provide an indication of the amount of time the passenger should expect to wait until arriving at that destination.

Figure 4:
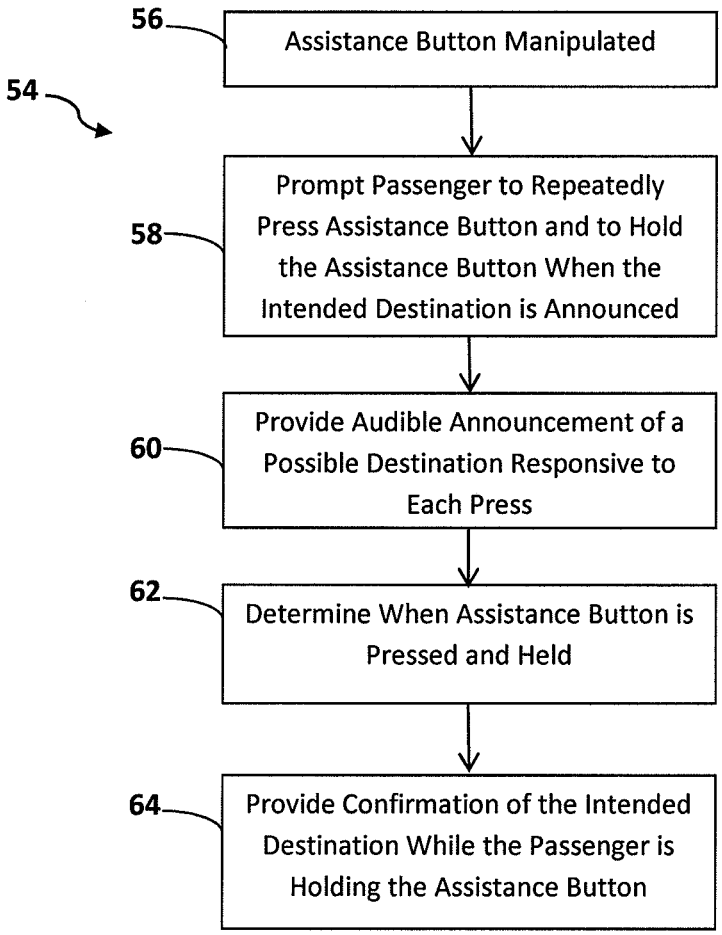
FIG. 4 is a flowchart diagram summarizing another example operation.

FIG. 4 includes a flowchart diagram 54 summarizing another example technique. At 56 the determination is made that the assistance button has been manipulated. At 58 the passenger is prompted to repeatedly press the assistance button 28 and to hold the assistance button when the intended destination is announced. At 60 an audible announcement of a possible destination is provided responsive to each press of the assistance button 28. In other words, the passenger is prompted to repeatedly press the assistance button 28 to sequentially change the possible destination until the passenger hears an audible announcement of the intended destination, and then to hold the button in a pressed position responsive to that announcement.

At 62 the controller 26 determines when the assistance button 28 is pressed and held. At 64 a confirmation is provided to the passenger, which is audible in this example, regarding the intended destination while the passenger is holding the assistance button 28. After hearing the confirmation of the intended destination, the passenger releases the assistance button 28 and proceeds to the appropriate elevator car based on information provided from the passenger interface 20 (or simply remains on the car in an embodiment in which the interface device 20 is within an elevator car).

Each of the examples mentioned above provides a different way of utilizing an assistance button 28 associated with a passenger interface device 20 that otherwise includes a touch screen 22 to allow passengers to obtain information regarding elevator service, and to provide an indication of requested elevator service. In each of those examples, the controller 26 causes audible announcements to be provided to assist a visually impaired or blind passenger with obtaining the desired elevator service.

In some situations, the number of floors to which the passenger could be carried is relatively large. Some examples include selecting a destination or floor at which to begin the announcements to shorten the time during which the passenger is waiting to hear an announcement of the intended destination.

In one example, the controller 26 begins the audible announcements using popular destinations. A determination regarding which destinations are popular may be gathered over time by the controller 26 by monitoring the number of selections of different destinations served by the elevator system. In another example, the controller 26 is preprogrammed to begin with preselected popular destinations.

One example includes using destinations that are popular based on a time of day. For example, during lunch time hours, the floor or floors on which a cafeteria or restaurant is located will be presented as the first options when the possible destinations are announced to a passenger who has manipulated the assistance button 28. In some examples, the announcement will indicate "cafeteria" instead of or in addition to the floor designation. Near the end of the day, a lobby or exit level of the building is a more popular destination and that will be presented as one of the first announcements at an appropriate time.

In another example, the controller 26 prompts the passenger to select a range of floors within which the passenger's intended destination is included. In a 40 story building, for example, the controller 26 will prompt the passenger to choose a range of floors 1-10, 11-20, 21-30 or 31-40 by providing an appropriate indication to the passenger that will allow them to make that selection. Once the appropriate range has been selected, the controller 26 begins to provide the announcement of possible destinations within that range. This allows a passenger to avoid having to hear audible announcements of floors 1-30 when the passenger desires to travel to floor 38, for example.

The examples described above allow for utilizing a touch screen display for a passenger interface and facilitating interactions between a physically impaired, visually impaired or blind passenger and an elevator system so that all passengers can obtain elevator service even though a touch screen is used as the primary input component to allow passengers to provide an indication of desired elevator service. Although visually impaired and blind passengers are mentioned in the above examples, passengers having other disability or impairments that would hinder them from successfully using the touch screen 22 but who can manipulate the assistance button 28 will be able to obtain the desired elevator service.

The above examples contain various features that are not necessarily exclusive to one particular embodiment. In other words, it is possible to combine features from the disclosed examples.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator passenger interface device, comprising:
a touch screen configured to allow a passenger to indicate a request for elevator service by touching the screen;
an assistance button near the touch screen; and
a controller configured to
determine a destination requested by a passenger touching the screen, and
determine whether the assistance button has been manipulated and then to determine a destination requested by a passenger from a subsequent manipulation of the assistance button
wherein the controller is configured to
determine that the assistance button has been pressed and released,
prompt the passenger to press and hold the assistance button a second time until the passenger hears an audible announcement of the passenger's desired destination from the device,
cause an audible announcement of a plurality of possible destinations to be provided to the passenger from the device, and
determine the passenger's intended destination based on a timing that the assistance button is released relative to the audible announcement.

2. The device of claim 1, wherein the controller is configured to determine the passenger's intended destination to correspond to the most recently announced destination prior to the when the passenger released the assistance button.

3. An elevator passenger interface device, comprising:
a touch screen configured to allow a passenger to indicate a request for elevator service by touching the screen;
an assistance button near the touch screen; and
a controller configured to
determine a destination requested by a passenger touching the screen, and
determine whether the assistance button has been manipulated and then to determine a destination requested by a passenger from a subsequent manipulation of the assistance button
wherein the controller is configured to
determine that the assistance button is being pressed,
prompt the passenger to hold the assistance button until the passenger hears an audible announcement of the passenger's desired destination from the device,
cause an audible announcement of a plurality of possible destinations to be provided to the passenger from the device, and
determine the passenger's intended destination based on a timing that the assistance button is released relative to the audible announcement.

4. The device of claim 3, wherein the controller is configured to determine the passenger's intended destination to correspond to the most recently announced destination prior to the when the passenger released the assistance button.

5. An elevator passenger interface device, comprising:
a touch screen configured to allow a passenger to indicate a request for elevator service by touching the screen;
an assistance button near the touch screen; and
a controller configured to
determine a destination requested by a passenger touching the screen, and
determine whether the assistance button has been manipulated and then to determine a destination requested by a passenger from a subsequent manipulation of the assistance button
wherein the controller is configured to
determine that the assistance button has been pressed,
cause the device to provide an audible indication of a possible destination responsive to each subsequent press of the assistance button,
prompt the passenger to press the assistance button repeatedly until the passenger hears an announcement of the passenger's intended destination and to hold the button in a pressed position when the intended destination is announced until the passenger hears a confirmation of the intended destination,
provide an audible confirmation of a destination corresponding to an announced destination prior to the passenger holding the button in the pressed position, and
determine the passenger's intended destination to be the destination of the confirmation.

6. The device of claim 5, wherein the controller is configured to
provide audible indications of possible destinations to the passenger responsive to determining that the assistance button has been pressed,
provide an audible selection to the passenger of a plurality of possible starting destinations from which to begin the audible indications.

7. The device of claim 5, wherein the controller is configured to provide an audible indication of possible destinations to a passenger responsive to determining that the assistance button has been pressed, wherein the audible indications begin with at least one destination that has been selected as a first option based on a popularity of the at least one destination.

8. The device of claim 7, wherein the controller is configured to select the at least one destination based on a time of day.

9. A method of facilitating an elevator service request from at least one passenger, comprising the steps of:
determining a destination requested by a passenger responsive to a passenger touching an appropriate portion of a touch screen of a passenger interface device configured to allow a passenger to indicate a request for elevator service by touching the screen and an assistance button near the touch screen; and determining a destination requested by a passenger responsive to a passenger manipulating the assistance button and then subsequently manipulating the assistance button;

determining that the assistance button has been pressed and released;

prompting the passenger to press and hold the assistance button a second time until the passenger hears an audible announcement of the passenger's desired destination from the device;

causing an audible announcement of a plurality of possible destinations to be provided to the passenger from the device; and determining the passenger's intended destination based on a timing that the assistance button is released relative to the audible announcement.

10. A method of facilitating an elevator service request from at least one passenger, comprising the steps of:

determining a destination requested by a passenger responsive to a passenger touching an appropriate portion of a touch screen of a passenger interface device configured to allow a passenger to indicate a request for elevator service by touching the screen and an assistance button near the touch screen; and determining a destination requested by a passenger responsive to a passenger manipulating the assistance button and then subsequently manipulating the assistance button;

determining that the assistance button is being pressed;

prompting the passenger to hold the assistance button until the passenger hears an audible announcement of the passenger's desired destination from the device;

causing an audible announcement of a plurality of possible destinations to be provided to the passenger from the device; and determining the passenger's intended destination based on a timing that the assistance button is released relative to the audible announcement.

11. A method of facilitating an elevator service request from at least one passenger, comprising the steps of:

determining a destination requested by a passenger responsive to a passenger touching an appropriate portion of a touch screen of a passenger interface device configured to allow a passenger to indicate a request for elevator service by touching the screen and an assistance button near the touch screen; and determining a destination requested by a passenger responsive to a passenger manipulating the assistance button and then subsequently manipulating the assistance button;

determining that the assistance button has been pressed;

causing the device to provide an audible indication of a possible destination responsive to each subsequent press of the assistance button;

prompting the passenger to press the assistance button repeatedly until the passenger hears an announcement of the passenger's intended destination and to hold the button in a pressed position when the intended destination is announced until the passenger hears a confirmation of the intended destination;

providing an audible confirmation of a destination corresponding to an announced destination prior to the passenger holding the button in the pressed position; and determining the passenger's intended destination to be the destination of the confirmation.

12. The method of claim 11, comprising:

providing audible indications of possible destinations to the passenger responsive to determining that the assistance button has been pressed; and providing an audible selection to the passenger of a plurality of possible starting destinations from which to begin the audible indications.

13. The method of claim 11, comprising providing an audible indication of possible destinations to a passenger responsive to determining that the assistance button has been pressed; and beginning the audible indications with at least one destination that has been selected as a first option based on a popularity of the at least one destination.

14. The method of claim 13, comprising selecting the at least one destination based on a time of day.

15. The method of claim 10, comprising:

providing audible indications of possible destinations to the passenger responsive to determining that the assistance button has been pressed; and providing an audible selection to the passenger of a plurality of possible starting destinations from which to begin the audible indications.

16. The method of claim 10, comprising providing an audible indication of possible destinations to a passenger responsive to determining that the assistance button has been pressed; and beginning the audible indications with at least one destination that has been selected as a first option based on a popularity of the at least one destination and a time of day.

17. The method of claim 9, comprising:

providing audible indications of possible destinations to the passenger responsive to determining that the assistance button has been pressed; and providing an audible selection to the passenger of a plurality of possible starting destinations from which to begin the audible indications.

18. The method of claim 9, comprising providing an audible indication of possible destinations to a passenger responsive to determining that the assistance button has been pressed; and beginning the audible indications with at least one destination that has been selected as a first option based on a popularity of the at least one destination and a time of day.

19. The device of claim 1, wherein the controller is configured to provide audible indications of possible destinations to the passenger responsive to determining that the assistance button has been pressed, provide an audible selection to the passenger of a plurality of possible starting destinations from which to begin the audible indications.

20. The device of claim 1, wherein the controller is configured to provide an audible indication of possible destinations to a passenger responsive to determining that the assistance button has been pressed, wherein the audible indications begin with at least one destination that has been selected as a first option based on a popularity of the at least one destination and a time of day.

21. The device of claim 3, wherein the controller is configured to provide audible indications of possible destinations to the passenger responsive to determining that the assistance button has been pressed, provide an audible selection to the passenger of a plurality of possible starting destinations from which to begin the audible indications.

22. The device of claim 3, wherein the controller is configured to provide an audible indication of possible destinations to a passenger responsive to determining that the assistance button has been pressed, wherein the audible indications begin with at least one destination that has been selected as a first option based on a popularity of the at least one destination and a time of day.

* * * * *